US010184629B2

(12) United States Patent
Davis

(10) Patent No.: US 10,184,629 B2
(45) Date of Patent: Jan. 22, 2019

(54) WINDOW ILLUMINATION ENHANCER

(71) Applicant: Jason E. J. Davis, Ottawa (CA)

(72) Inventor: Jason E. J. Davis, Ottawa (CA)

( * ) Notice: Subject to any disclaimer, the term of this patent is extended or adjusted under 35 U.S.C. 154(b) by 134 days.

(21) Appl. No.: 15/080,552

(22) Filed: Mar. 24, 2016

(65) Prior Publication Data

US 2016/0281944 A1 Sep. 29, 2016

(51) Int. Cl.

| | |
|---|---|
| ***F21S 11/00*** | (2006.01) |
| ***E06B 7/28*** | (2006.01) |
| ***E04F 17/06*** | (2006.01) |
| ***F21V 7/05*** | (2006.01) |
| ***F21V 33/00*** | (2006.01) |
| *E06B 9/24* | (2006.01) |

(52) U.S. Cl.

CPC ..... *F21S 11/007* (2013.01); *E04F 17/06* (2013.01); *E06B 7/28* (2013.01); *F21V 7/05* (2013.01); *F21V 33/006* (2013.01); *E06B 2009/2417* (2013.01)

(58) Field of Classification Search

CPC ..... F21S 11/00; F21S 11/007

See application file for complete search history.

(56) References Cited

U.S. PATENT DOCUMENTS 3,382,781 A * 5/1968 Hamilton ..... A61B 1/00142 396/16
3,512,878 A * 5/1970 Scott ..... G02B 23/08 359/857
3,703,791 A * 11/1972 Slade ..... E04F 17/06 52/107
3,844,076 A * 10/1974 Schock ..... E04F 17/06 52/107
4,110,011 A * 8/1978 Tausch ..... G02B 7/1805 359/633
5,159,366 A * 10/1992 Gell, Jr. ..... G03B 17/08 206/811
8,690,359 B1 * 4/2014 Clock ..... G02B 7/1824 353/99
2006/0164516 A1 * 7/2006 Kurosawa ..... H04N 5/23248 348/208.99
2009/0015915 A1 * 1/2009 Bellandi ..... F41H 5/266 359/402

(Continued)

FOREIGN PATENT DOCUMENTS

CA 2303691 A1 * 10/2001 ..... E04F 17/06
CN 202165988 U * 3/2012
DE 19932054 A1 * 1/2001 ..... E04F 17/06

*Primary Examiner* — Charlie Y Peng

(57) ABSTRACT

A window illumination enhancer having at least one planar reflective surface and two openings is designed to fit in a window well of a building. The surface reflects light from a first of the openings through the window, via the second opening. The first opening is located above the window well. A polymer film surrounds the path of the light between the two openings to reduce soiling of at least the surface. A second planar reflective surface may be included and may be arranged to form a periscopic device, which affords an above-ground view of the exterior. The enhancer may be composed of lightweight materials. It may be freestanding, and may be mounted without fixing to the building wall. Illumination is increased because the view of the dim-lit window well wall is blocked by the more brightly lit surface.

18 Claims, 5 Drawing Sheets

(56) References Cited

U.S. PATENT DOCUMENTS

| | | | | |
|---|---|---|---|---|
| 2014/0254035 | A1* | 9/2014 | Aizpuru | G02B 23/08 359/857 |
| 2017/0081863 | A1* | 3/2017 | Bramble | E04F 17/06 |

* cited by examiner

WINDOW ILLUMINATION ENHANCER

FIELD OF THE INVENTION

The present invention relates in general to passive, window illumination enhancing devices for directing more daylight into a building through a window, and/or presenting a view through the window at an angle that would otherwise only offer an undesirable view, such as a view of a wall of a window well. In particular, the invention relates to such devices, and kits for assembling such devices, for positioning outside of a window, such as a basement window, with one or more planar reflective surfaces that is easier to maintain and install.

BACKGROUND OF THE INVENTION

The idea of using a periscopic device to increase illumination of basement windows is well recorded in the patent literature and yet Applicant can find no evidence of any commercial use having been made of them. By a periscopic device, herein is intended, a device having a pair of rectangular plane reflectors arranged as if the two reflectors were initially placed on top of each other, reflective sides facing with the four corners meeting, and then separated by a translation in exactly two directions: a direction of the normals of the reflectors, and a direction of the minor axis of the rectangles. Typically: the translation is equal in both of these directions; the minor axis is about $2^{1/2}$ times a height of the basement window; and the distance between the centers of the reflectors is at least the height of the basement window, as this allows for the smallest reflectors to be used to project a periscopic view across the full height of the window. By suitably positioning such reflectors in front of the basement window, a view is reflected off the two mirrors, and into the window.

There appear to be two kinds of these periscopic devices: enclosed units, and simpler arrangements that are not enclosed.

DE 19932045 to Reischl teaches a pair of mirrors forming a static periscope in an enclosure. The enclosure has windows and a sealed cover and appears to be built-in around the building. CA2303691 to Berkers teaches another built-in looking device with a fixed periscopic light enhancer. Berkers teaches that you can get side and front views by folding the top mirror back at two edges that run at an angle between the front and rear of the top reflective surface. Again seals are required and a built-in system requires matching specifications of the windows. Berkers indicates that if the device is installed in a new building, no window well is required. Also U.S. Pat. No. 8,690,359 to Clock teaches a design having controlled tilting of the top and bottom mirrors, either manually or by motors. Clock's apparatus involves a sealed transparent cover that meets a rim of a window well. As window wells come in a variety of different shapes and sizes, it may be difficult to get a matching sealed edge with such enclosures. Furthermore there are at least 8 brackets mounted to the outer wall of the building, above and below grade. Some homeowners would prefer not to drill holes into a foundation or wall of a house. Finally, those who wish to open the bottom window to ventilate the basement room may not prefer to have to release this seal to do so.

Drainage and mold may be problematic with enclosed devices. Constructing such devices requires work to match external cladding of the house, producing the required seals and structural support required of the device, which is exposed to the elements. In some municipalities, such an alteration of a building envelope may require a building permit. Installation of any of these built-in systems is expensive and time consuming. Fixing and sealing built-in systems will depend on the cladding, as well as the size of the window and window well. All of this requires skilled labour and design work.

Several patents show planar redirection of light for basement windows, other than periscopic devices. Several of these use the same built-in structures as above. CN202165988, shows an apparatus with built-in mirrors, windows, and a sealed unit. U.S. Pat. No. 6,502,950 to Signer et al., teaches a set of multi-reflection installations built-into static window wells. Seals and covers are employed, but the system is not periscopic, and does not afford views of a horizon, as much as of the sky. These add complexity and cost to the built-in system. Some embodiments use curved reflective surfaces. There is some interest in improving ventilation of the window at the same time as improving light collection from, or imaging of the sky. Signer et al. also shows embodiments where a plane of illumination of the view is not oriented horizontally or vertically.

JPH11111026 has drawings showing a variety of far simpler devices that consist of mirror arrangements within a window well. While much simpler to install, such an arrangement is far more difficult to maintain. Dirt, leaves, debris, snow, rain, and all particulate matter may settle into window wells, and will frequently require cleaning of these simpler to install systems, or will result in decreasing illumination via the mirror arrangement. These drawings also show, though highly schematically, illumination path diversity.

JP2004031365 shows a drawing of a pair of mirrors, a bottom mirror tilted as if in a periscopic arrangement, and a top mirror above a roof of the wall, for directing light onto the bottom mirror from around the building. The mirrors are arranged with normals meeting in a common plane, at an angle of about 90°.

There remains a need for a technique for forming a planar reflective illumination device (PRID) for a basement window in a variety of window wells, that can be assembled without being built-in, and avoiding fasteners that penetrate, or permanently adhere to the building, to define a free standing structure, but can be maintained more easily than a set of mirrors.

SUMMARY OF THE INVENTION

Applicant has invented a PRID that is easier to maintain and install, for enhancing illumination through a window, such as a basement window in a window well.

Accordingly a planar reflective illumination device (PRID) is provided, the PRID including: a first planar reflective surface; first and second light entrances each having dimensions and orientation matching projections onto the first surface; and a structure of connected members for supporting the first surface and the entrances in at least one fixed arrangement, in which: first and second optical paths respectively between the first surface and the first and second entrances are not obstructed by any part of the PRID; and a mean length of the first optical path is at least one of: 3 times greater, or 4 feet longer, than that of the optical path to the second light entrance.

The second optical path may be linear, and the first optical path may include a second planar reflective surface, the second surface being oriented with respect to the first entrance and first surface to reflect a view from the first entrance onto the first surface, such that the view is projected through the second entrance.

The first entrance may be vertically aligned with the second surface, and the first surface may be vertically aligned with the second entrance, such the PRID is rotationally symmetric.

The PRID may further include a third entrance and a third path extending from the third entrance to the first surface, the third path oriented to reflect the view from the third entrance off the first surface onto the second entrance.

Center normals of the first and second surfaces may lie in a common, non-degenerate, plane. A line segment extending between the centers of the first and second surfaces may be longer than a smallest planar dimension of the surfaces. Interior angles between the line segment and surfaces in the plane, on a same side of the line segment may sum to 170° to 190°.

The first and second entrances may extend substantially perpendicularly to the respective optical paths adjacent the respective entrance in at least one of the fixed arrangements.

The first surface may be a rectangular section of a reflective foil or web with a stiffening backing.

The structure may define a frame that is collapsible by separating or moving joints connecting the members, the joints being lockable in one or more of the fixed arrangements.

The PRID may further include a grounding mechanism mechanically coupled to the structure for retaining the PRID in position in a window well. The grounding mechanism may include at least one of: a tensionable line with a ground coupling, a weight, a compression rod, and a clamp for attachment to a rim of a window well.

The polymeric film, away from the entrances, may be reflective of light to a higher degree, than at the entrances, for at least one band of wavelengths and angles of incidence.

The PRID may further include a reflective member on at least one of a front and a rear wall of the PRID away from the entrances, the reflective member located inside or outside the film.

A kit is provided for assembly to form a planar reflective illumination device (PRID), the kit including: a first planar reflective surface; a collection of members interconnectable to define a structure for supporting the first surface; and a polymeric film for surrounding at least a part of the structure where: the structure provides first and second optical paths extending from the first surface to first and second entrances respectively, without obstruction by any part of the PRID, an angle of projection onto the first surface of a view from the first entrance via the first path is reflected onto the second path to exit the PRID at the second entrance.

The kit may further include a grounding mechanism mechanically coupled to the structure for retaining the PRID in position, the grounding mechanism comprising at least one of: a tensionable line, a weight, a clamping mechanism for securing to a rim of a window well, and a compression rod.

The kit may further include a second planar reflective surface held by the structure with respect to the first surface in a fixed arrangement providing reflection of a view from the first entrance by the second surface, and subsequent reflection of the view by the first surface, for projection through the second entrance.

The assembled structure may provide the second surface vertically aligned with the first entrance, and the first surface vertically aligned with the second entrance.

A planar reflective illumination device (PRID) is also provided, the PRID having: a first planar reflective surface formed of a reflective foil or web with a stiffener; first and second light entrances each having dimensions of a basement window positioned and oriented to project a view onto the first surface, and; a structure of connected members for supporting the first surface and the entrances in at least one fixed arrangement. In the at least one fixed arrangement, first and second optical paths respectively between the first surface and the first and second entrances are not obstructed by any part of the PRID. The PRID is self-supporting without attachment to a wall bearing the window.

The PRID may be a periscopic device.

The structure may include a frame of interconnected members adapted to pivot the first surface with respect to at least one of the first and second surfaces.

The structure may include a frame that is adapted to collapse the PRID into a substantially flat arrangement for storage or shipping.

The PRID may include a grounding mechanism mechanically coupled to the structure, for retaining the PRID in position. The grounding mechanism may include at least one of: a tensionable line, a weight, a clamping mechanism for securing to a rim of a window well, and a compression rod. Thus the PRID can be positioned in the window well in a self-supporting manner, without attachment to a wall bearing the window.

A kit is provided for assembly to obtain any PRID as described above.

BRIEF DESCRIPTION OF THE DRAWINGS

A better understanding of the features of the invention, and how they may be embodied is afforded with an understanding of the attached drawings, in which.

DESCRIPTION OF THE PREFERRED EMBODIMENTS

Herein a planar reflective illumination device (PRID) and kit for making same, are described for improving illumination of a basement window. In this disclosure, reference is made to several geometrical and physical idealizations. These references are not intended to refer to perfect forms, but to practical approximations thereto.

FIGS. 1-5 are side elevational views of respective PRIDs, in accordance with respective embodiments of the present invention. These embodiments show optical features of the PRIDs, with little reference to structural features.

Figures 1, 2, 3, 4, 5:
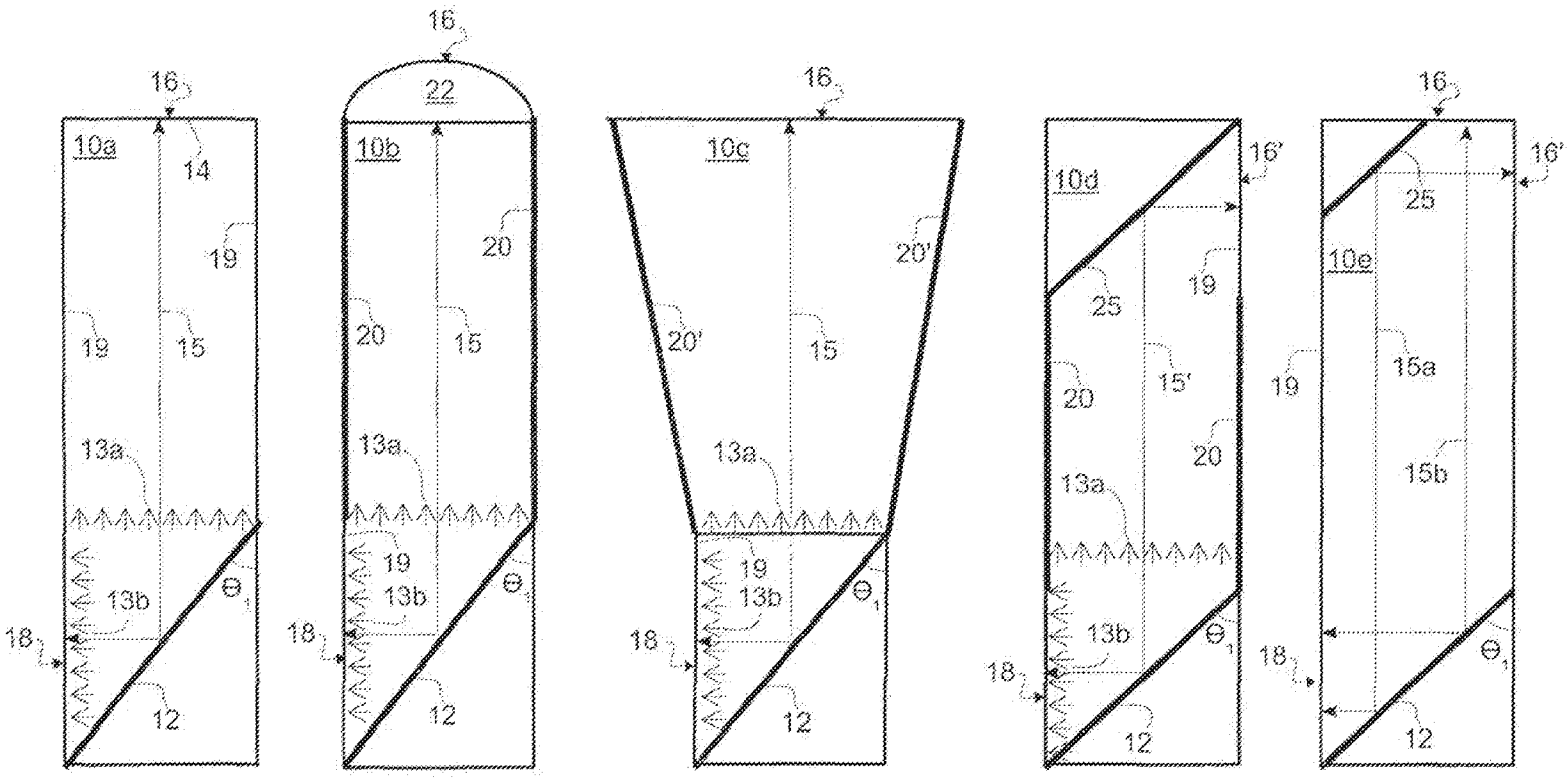
FIG. 1 is a schematic illustration of a side view of a planar reflective illumination device (PRID) suitable for projecting a view of a sky into a basement window.
FIG. 2 is a schematic illustration of a side view of a PRID having a light gathering feature.
FIG. 3 is a schematic illustration of a side view of a PRID having tapered reflective walls.
FIG. 4 is a schematic illustration of a side view of a periscopic device PRID.
FIG. 5 is a schematic illustration of a side view of a hybrid PRID having a periscopic view and a sky view.

FIG. 1 is a schematic illustration of a first embodiment of a PRID 10*a* in accordance with the present invention, which uses a single planar reflective surface 12. The surface 12 has two projections 13*a,b* that correspond according to the law of reflection, leading to a substantially L shaped optical path 15 through the PRID 10*a*. As such the normal of the surface 12 bisects the projections 13*a,b*. The optical path 15 consists of first and second paths that extend from the surface 12 to a first light entrance 16, and a second light entrance 18, respectively. While the optical path 15 is shown as a single centerline thereof that extends from a center of the surface 12, it will be appreciated that the optical path 15 extends a breadth of the device, for the illustrated projections. Other projections that correspond by the law of reflection will also be transmitted through the PRID 10, but these will be truncated (in the vertical direction of the view) by an amount that varies with an angle with respect to the illustrated projections.

First 16 and second 18 light entrances each have dimensions matching projections onto the surface 12 so that at least a view incident the first entrance 16 reflects off of the surface 12, and passes through the second entrance 18, and indeed, in the present embodiment, for the projection shown, a full view incident the first entrance 16 passes through the second entrance 18. No part of the PRID 10*a* obstructs or occludes any part of the path 15 within the PRID 10*a* between the entrances.

Herein a planar reflective surface refers to a surface for reflecting plane waves of light, and therefore views are understood to include warped images if the planar reflective surface is not itself flat, but focuses or distorts the view. A flat mirror is shown in cross-section in FIG. 1, and a flat surface has particular advantage for presenting views that are unwarped, and for producing a compact PRID, although nearly the same compactness may also be provided by Fresnel type reflectors. A complex reflector having a first surface for reflecting visible light, and a Fresnel type reflector for focusing and reflecting IR light, for example, can be useful. It may be particularly valuable to focus light to a given distance from the window, into a room of the building.

Second entrance 18 is an undifferentiated region of a rear wall of the PRID 10*a*, and the first entrance 16 is a ceiling of the PRID 10*a*. While the ceiling may be an entrance in some embodiments, especially if the walls extend a height that is sufficient for most particulate material to not be entrained into an interior column of the PRID 10*a*, the present illustration shows a transparent top that forms the optical entrance 16.

Surrounding the optical path 15, is a film of polymer 19 that forms front, back and side walls of the PRID 10*a*. The film 19 may be formed as a bag, or a sheath open at both opposite ends, or may be a film wrapped, folded or attached along a seam. The film 19 may be shrunk, for example with heat, to make a tight enclosure.

The first and second entrances 16,18 are provided by an optical medium that is at least partially transparent over a range of optical and/or infrared frequencies. As entrance 16 is provided through the polymer film 19, the film preferably has this property. The film 19 may block infrared light and transmit visible light into a house, for example, to illuminate a building or house in a season or at a location, where cooling of the house is desired. In seasons or areas where the house is typically desired to be heated, the infrared spectrum may be desirably transmitted through the PRID. In other situations it may be desirable to use the PRID 10*a* to project more IR radiation than visible light into a building, to improve heating without increasing lighting. While a substantial amount of heat can be derived from the visible spectrum, this may desirably be filtered or reflected by the entrances 16,18.

The film 19 has several advantages: it limits entrainment of particles onto the surface 12, and greatly reduces a surface area of the PRID that will require cleaning. It will be noted that lawnmowers, and other particulate spraying machinery tend to soil planar reflective surfaces 12 if the surface is not covered, and frost, and precipitation may impair reflectivity of a planar reflective surface. While covering on all sides is advantageous, and accordingly it is desirable to cover the top and sides of the PRID in some embodiments, if the front, back, and side walls are tall enough, that alone may sufficiently suppress such soiling to substantially reduce cleaning requirements for the PRID. Thus the part of the optical path 15 from surface 12 to the first entrance 16 is surrounded by the film 19, and that part of the optical path is at least 3 times, or at least 4 feet longer than, the part from surface 12 to entrance 18. As such, a distance of the top of the PRID above ground is high enough to limit soiling, as sprays of debris from lawnmowers, and the like, are far denser closer to the ground. While the PRID 10 is shown with the front and rear walls meeting the ceiling at a common elevation, this is by no means necessary. It may be advantageous to have a sloping ceiling to reduce soiling of the entrance 16.

The projections 13*a,b* are chosen so that a view illuminating entrance 16, reflected by the surface 12, will be transmitted through entrance 18. By suitable selection of an angle $\Theta_1$, a whole view illuminating entrance 18 is projected onto entrance 16, for a particular angle of the view. For example, if $\Theta_1$ chosen to be 45°, the two projections will make angles of 45° with respect to the surface 12. At incident angles of the entrance 16, other than vertically upward, a limited extent of the surface 12 will reflect the view, some of the incident view falling on either the front wall or back wall (including directly on the entrance 18). Some of the light from these views will be reflected back through entrance 16 or transmitted through the front or back walls, but a range of views around the vertical will be presented to the user at a range of viewing angles. A viewing angle at which a full vertical extent is projected may be chosen to exclude from the view, any part of an overhang of the building, for example by selecting $\Theta_1$ to be at an angle above 45°, and by extending a width of the surface 12 accordingly.

The film 19 forming the front and back walls may be substantially transparent at angles of incidence near normal, but at a grazing angle of incidence, may be substantially reflective, which would provide for less loss of light from the near vertical angles.

It will be noted that the part of the PRID below the surface 12 does not provide any part of the optical arrangement of the PRID 10*a*, and may be removed, or loaded with heavy material for anchoring. The film 19 need not extend below the surface 12 as shown. It may be convenient to support the PRID 10*a* at this area.

FIG. 2 is a schematic illustration of a PRID 10*b* in accordance with the present invention. This embodiment adds two additional features to the embodiment of FIG. 1, the remainder being unchanged from the PRID 10*a*. Herein common reference characters in different figures denote features with equivalent function and features, and their descriptions are not repeated. Specifically, the two features are reflective front and back walls 20, and a light gathering optical feature 22.

To the extent that the back and front walls 20 are made reflective, light cannot escape the PRID 10*b* at these faces. Light that does not singly reflect off of the surface 12 will generally reflect multiple times and eventually exit at entrance 16 or 18. While a range of views of the sky are presented to the entrance 18 at different angles by singly reflected light, in the same manner as in PRID 10*a*, a total illumination at entrance 18, and a mean pattern of illumination representing how the spatial (principally the vertical extent of the light from the entrance 18) and angular (angles of declination and inclination viewing the entrance 18) distribution of light will be different with these two devices. In general, higher reflectivity of the front and back wall will improve total light presented at both entrances 16,18, and will also make the distribution less uniform, but will have strong intensity peaks at respective angles and vertical positions.

It will be noted that if the front wall is made reflective, a view through the entrance 18 and through the front wall is precluded. This comes at the expense of a natural view through the window, which may not be preferred by some users. Those with an uninteresting view in front of the basement window may prefer higher reflectivity and those with a desired view may prefer a transparent front wall. It will be appreciated that selection of a best PRID depends on the specific orientation of the window, locations of obstructions around the window, and paths of the sun, which suggest that a flexibility to allow a user to vary the coverage of the reflective walls may be preferred.

The reflective back and/or front walls 20 can be provided as foils or tapes separate from the polymer film 19, or may be laminated or otherwise joined with the film 19. An advantage of joining the film is a smaller parts count and potentially easier assembly. An advantage of a kit or PRID that has, at least initially, separated reflective back/front walls 20, is that the PRID can be specialized for particular settings, allowing for the opening or closing of the reflective walls 20. For example, the front wall 20 just above the surface 12 may afford a view of the outdoors that one customer would like to keep. This customer may cut, fold, or otherwise prevent the front wall 20 from obstructing this view, if the polymer film 19 is separate, but might have less flexibility to do so if the reflective surface was joined with the film 19.

The reflective back and/or front walls 20 may be provided inside the film 19, or surrounding the film 19. In the former case, a thickness and index of refraction of the film 19 can be considered when selecting a material having a desired reflectance at a desired range of angles, for a desired range of frequencies of incoming light (visible or otherwise).

Fortunately, angular diversity affords an alternative to the strictly reflective or transmissive front or back walls. It will be noted that many clear plastic films have indices of refraction (1.3-1.6) that, adjacent to air, tend to reflect more light at grazing angles of incidence, but exhibit high transmissions nearer normal incidence, and thus the film 19 may conveniently provide desirable tradeoff between the two, providing essentially angle of incidence selective reflective front and back walls. Specifically, the angular diversity of incident light permits grazing angles of light to be reflected while views at angles closer to normal may exhibit little reflection, which permits views through the PRID front wall to be dimmed by a small amount while permitting substantially more incident light from the sky (at angles closer to vertical) to be reflected by the front and back walls, allowing for an increase in illumination. Angles of a front wall and light entrance 18 may therefore be chosen to minimize reflection of the view through the narrow range of angles between a rim of a window well and a highest viewing angle.

It will be noted that the reflective back wall 20 delimits the entrance 18 of PRID 10*b*.

The second feature of PRID 10*b* is light gathering optical feature 22, preferably has a high light gathering power. Some examples of such devices include lenses, including Fresnel lenses, and like compact, spatially divided lenses. The feature 22 may be composed of a higher index of refraction material, which may or may not be supplied in a kit for producing the PRID.

Simple, low-cost, optical features 22 may be preferred. For example, a preformed bag may be provided at the top of the PRID 10*b*, or may be optionally mounted thereto, that is adapted to be filled with water, and sealed; the water providing a higher index of refraction (1.3) medium for light than air, shaped by a container, may provide a high light gathering power optical feature 22, without adding a packing weight to the device. A thermal stabilizer such as an alcohol, may be needed for colder climates.

Additionally, or alternatively, a sealed form may be filled with a fine rutile powder. Rutile, being an abundant and inexpensive material with good optical clarity and very high index of refraction, can substantially improve light gathering power of a low-cost optical feature 22. It will be noted that coarser powders may disrupt and distort a view of the sky, but would still increase an angular extent of the sky from which the light is collected. An undistorted view of the sky may not be particularly preferable.

Shaping of the optical feature 22 may be hemispherical, hemielliptical, demi-cylindrical, or a spatially divided approximation thereto, in the manner of a Fresnel lens. If lighting is more important than a view of the sky, a variety of lenses that exhibit blurring, chromatic aberrations, and any number of other aberrations and spatial defects may be perfectly acceptable, and may provide a desired angular and vertical distribution of light intensity.

FIG. 3 is a schematic illustration of a PRID 10*c* having flared front and back walls 20', that increase a light gathering power of the device by virtue of a wider entrance 18. Herein in general, features of the respective embodiments illustrating the invention can be combined with those of other embodiments, except insofar as it is problematic to do so, or otherwise explained herein. Thus, for example, a further optical feature 22 can be designed for cooperation with flared front and back walls 20' of PRID 10*c*, or any other embodiment.

FIG. 4 is a schematic illustration of a PRID 10*d* with a second planar reflective surface 25. PRID 10*d* has a rotationally symmetric light path 15'. Accordingly the light entrance 16' is positioned at a top of the front wall instead of at the top of the PRID as it was in embodiments described above. As mentioned in the prior art, there are various reasons for wanting to do this, including providing security and affording an occupant a pleasing view of the outdoors. Depending on a slope and elevation of the house or building around the basement window, and any obstructions around the same, it may be preferable to provide a view above the ground at least as high as 4 feet above grade, as this corresponds to most views. It is somewhat unnatural to view a landscape at a height of only 1-2 feet. Furthermore, at higher elevations, the entrance 16' is less subject to soiling or obstruction from snow accumulations.

Inclusion of the second surface 25, makes PRID 10*d* a periscopic device. As shown, the periscopic device is rotationally symmetric, although this is not necessary. In the illustrated embodiment, the second surface 25 is parallel to surface 12, and so the normals of the two surfaces are parallel. Center normals of the first and second surfaces, i.e. normal vectors extending from geometric centres of the respective surfaces, both lie in a unique common plane. This means that the centre normals of both surfaces are not collinear, and that the surfaces are not tilted with respect to each other in both pitch and yaw. For efficiency, the surfaces are rectangular, and arranged to bound a parallelogram prism. Ideally the rectangular surface has a length of a length of the window, and a height equal to a height of the window times a cosine of $\Theta_1$.

A line segment joining the centres of the two surfaces 12,25 is preferably longer than a smallest planar dimension of the surfaces, so that the entrance 16' can have a vertical extent that allows for normal light to be projected onto the full extent of second surface 25, and is longer still to raise the entrance 16' above grade.

The periscopic device PRID 10*d* has mirrors making 45° angles with the entrances 18,16'. While this may be preferred, as it leads to a minimum depth (distance between front and back walls) of the PRID 10*d*, and maximum illumination (in the sense of the full depth of the path 15') at right angles, it will be appreciated that in some situations it may be preferred to provide the full depth path at an angle of depression, such that the eye of an occupant of the basement room adjacent to the window, does not have to be at the height of the window to see the full depth view. As such an angle less than 45°, such as an angle above 30°, may be preferred. This may lead to a view with an angle of elevation of 30°, for example. To imagine this, simply tilt the projection arrows 13*b* by the 30° downwards, and provide the corresponding tilt to the angle $\Theta_1$ (which requires a lengthening of surface 12). The same projection 13*b* will result, as this represents the full depth view.

It should further be noted that the same effective change of angle can be provided by tilting the whole PRID 10*d*, for example, on the axis of symmetry of the PRID 10*d*. Two considerable advantages to tilting the whole PRID 10*d* over changing the angle $\Theta_1$ is that a length of the surface 12 does not have to be extended, and it may be easier to cost effectively vary an angle of the whole PRID 10*d* during mounting than to increase mobility of the parts within the PRID. However, the disadvantage is that either the PRID 10*d* had to initially have surfaces 12,25 that were designed for a window height that was greater than the window it is used for, or the PRID 10*d* offers no view that extends a full height of the window, at any angle of inclination or declination. As the PRID may be designed for a largest basement window on the market, a majority of basement windows may have a variety of angles at which they can have full depth views.

As long as the surface 25 is parallel to the surface 12, the angle of the view will be the same as the angle of the viewer. This means if the viewer's inclination or declination is fixed at an angle, the view through the periscopic device PRID 10*d* will be inclined or declined from the horizon by the same angle. While this may be desirable, and will certainly be intuitive for a viewer, the angles of tilt of a viewer's head, may or may not correspond with a desired view through a window. This may be accommodated by tilting the surface 25 independently of the surface 12, and extending a width of the surface that is tilted. A measure of this tilting can be made by looking at interior angles between the line segment joining centres of the surfaces 12,25 and surfaces in the plane shown in the drawings. If one considers the angles on a same side of the line segment, if they sum to 170°-190° (180° shown), the angle of elevation of the viewer, will substantially correspond to the angle of elevation of the view presented to the viewer's eye by the PRID. For angles higher or lower than that, the image will be inclined or declined.

FIG. 5 schematically illustrates a PRID 10*e*, that is a hybrid combination of PRIDs 10*a,d*, resulting in two optical paths 15*a,b* that are adjacent, and vertically separated for a viewer: optical path 15*a* is similar to 15' of PRID 10*d* coupled to entrance 16', and path 15*b* is similar to 15 of PRID 10*a*, coupled to entrance 16. Projections 13*a,b* are the same as in all previous embodiments, but are not illustrated to reduce a visual complexity of the drawing.

By variation of an extent of second surface 25, the depth of the PRID 10*e* can be divided between the two paths 15*a,b* in any ratio.

While PRID 10*e* shows a periscopic view presented schematically below the sky view, the surface 25 can be placed before or after, or in between two sky view openings. It will further be noted that the angular diversity of light transmitted through entrances 16 and 16' do not restrict light to non-overlapping paths.

While it may not be initially obvious to incorporate the flaring reflective front and back walls 20' of PRID 10*c* into the embodiments of FIGS. 4,5, it is entirely possible. A flared front wall may be used without a flared back wall. Such an embodiment can be produced by tilting the reflective front wall 20 of FIG. 4,5 to resemble front wall 20'. In such an embodiment the entrances 16,16' through film 19 may cease to be distinct, as a single opening defined at an angle between the two may provide both concurrently, or an edge can be defined to make the side profile of the PRID square, to retain distinct entrances 16,16'. Either way, a direct path of light from the sky onto the surface 12 may also meet the entrance 16' at an angle. Typically more light is reflected at angles further from normal incidence.

The optical arrangements discussed above require a structure to retain the surfaces with respect to the paths. The structure is composed of mechanically connected members, be they movably jointed, joined, fixed, or monolithic. The members may surround the film 19, the film 19 may surround the structure, or some members may be inside and others outside the film 19. FIGS. 6-8 schematically illustrate three embodiments of frames providing such structures. The frames show embodiments of periscopic devices, as this is the more complicated case, and simpler structures may be provided for sky view devices. It will be appreciated that a top surface of each embodiment can be replaced with a peripheral support member defining the entrance 16 of a PRID having no second surface 25.

Figure 6A:
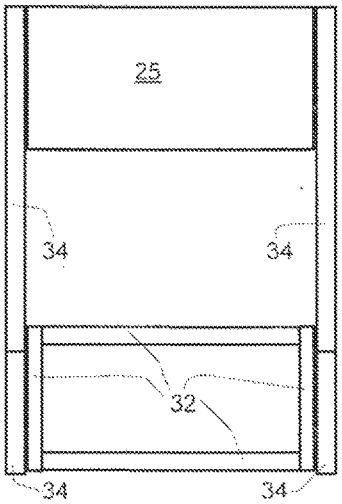
FIGS. 6A,B are schematic illustrations of front and side views of a frame for supporting a periscopic PRID.
Figure 6B:
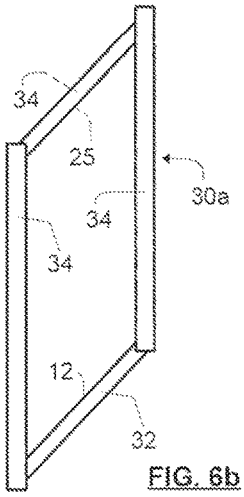

FIGS. 6*a,b* are front and side elevation views of a frame 30*a* for supporting surfaces 12,25. The frame 30*a* includes peripheral members 32 for supporting the respective surfaces 12,25, and four vertical members 34 of common length interconnecting the support members 32 at respective corners. If the vertical members 34 meet the peripheral members 32 at revolute joints that can be frictionally engaged to fix the members at the angles shown (or one or more other predefined angles or ranges of angles), the frame 30*a* can be made collapsible to a flat arrangement for storage and shipping, for example. Also, this collapsed form may be used for inserting the frame 30*a* into a plastic bag that defines the polymeric film, providing a suitable tension on the film when the frame is opened. It will be noted that removal of the surface 25 and tilting of the top peripheral members 32 produce a frame 30*a* for the PRID 10*a*. Further addition of the optical feature will produce a PRID 10*b*. Extension of two shorter sides of the top peripheral members 32, with a suitably plastically-deforming film 19, will produce the PRID 10*c*. Retention of the top surface 25, would produce the PRID 10*d*, if the peripheral members 32 meet the vertical members 34 at 45°/135°. A longitudinal cutting or folding of the surface 25 will produce the PRID 10*e*.

Figure 7A:
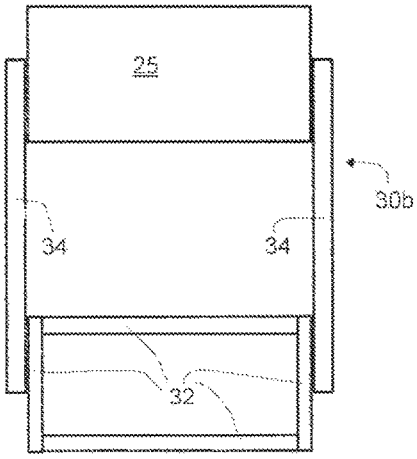
FIGS. 7A,B are schematic illustrations of front and side views of a canted I-shaped frame for supporting a periscopic PRID.
Figure 7B:
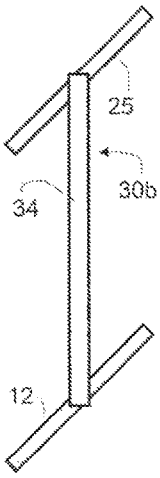

FIGS. 7*a,b* are front and side elevational views of a frame 30*b* that can be used alternatively to frame 30*a*. It will be appreciated that a number of supporting structures can accomplish the same function of supporting the surface/surfaces with respect to the entrances. Frame 30*b* has only two, vertical members 34 that join middles of the two shorter peripheral members 32.

Figure 8A:
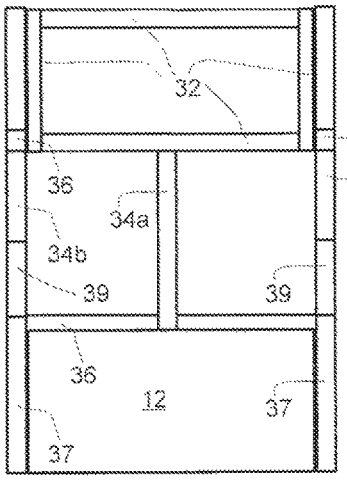
FIGS. 8A,B are schematic illustrations of front and side views of a frame for supporting a periscopic PRID with a spine connecting the planar reflective surfaces.
Figure 8B:
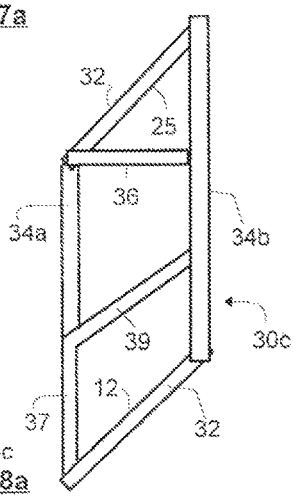

FIGS. 8*a,b* are rear and side elevational views of a frame 30*c* that is supported by a central spine 34*a* at the back, and two front pillars 34*b*. The front pillars 34*b*, and top peripheral member 32 form ¾ of a frame for an entrance 16' (not in view), and a bottom horizontal member is provided in horizontal elevation with horizontal member 36, to complete the frame. The horizontal member 36 reinforces a triangular prism between the surface 25 and entrance 16'. Similarly to how the entrance 16' is framed, a framing is provided around entrance 18. This framing includes a horizontal member 36 to which the spine 34*a*, and two side pieces 37 is mounted. Accordingly the spine 34*a* interconnects the framing of entrance 18 with a bottom of the peripheral member 32 for surface 25. The framing for entrance 18 is coupled to the pillars 34*b* by sloping members 39. It is possible to provide any number of additional supporting elements, depending on the need for rigidity, and to permit the PRID to endure wind and precipitation.

One advantage of the frame 30*c* is that an angle of the triangular prism can be varied by changing a mounting position of a top of the peripheral members 36 to the two front pillars 34*b*, for example, as long as some tilting is possible between the spine 34*a* and bottom peripheral member 32.

The above-described PRIDs are designed to be placed adjacent to a basement window 40 in a wall 42 of a building such as a house. The PRID may be specifically designed with a fixed range of basement window sizes in mind, and the PRID may be designed to be installed within a window well 44, with the entrance 16 substantially aligned with the window 40, so that one or more views of the PRID are projected through the window 40.

Figure 9:
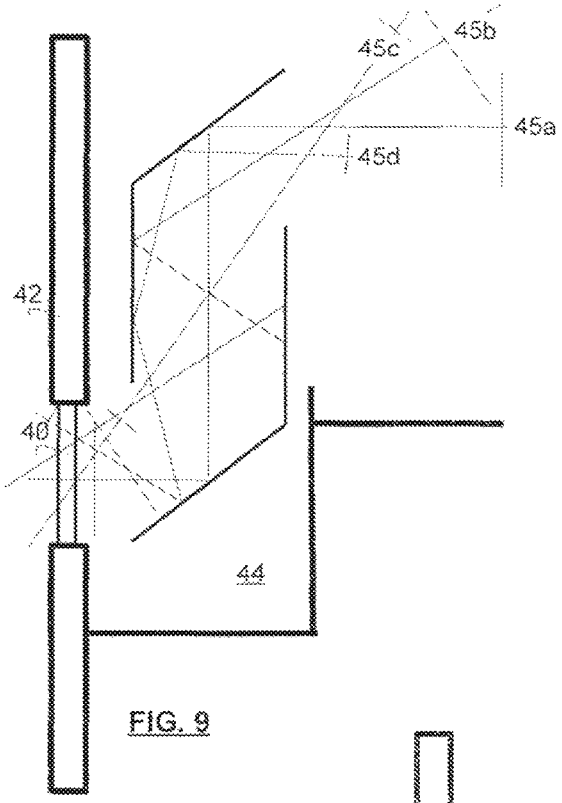
FIG. 9 is a schematic illustration of a side view of a periscopic device PRID, showing how a plurality of views can be projected into a basement window by angular diversity.

FIG. 9 is a schematic image illustrating view angle diversity with PRID 10*d*. The drawing does not purport to illustrate all views, but does show: a view 45*a* that is a standard periscopic view, with horizontal incident light and a horizontal projected view that is translated downwards; a view 45*b* that is also a periscopic view of sorts, with double reflection off of vertical front and rear walls 20, and accordingly having a same angle elevation of the view projected by the PRID 10*d*, as the incident view, but again with a downward translation; and a view 45*c* that has no reflection within the PRID 10*d*. It will be appreciated that a variety of views may be reflected off of two non-parallel walls, such as the rear wall 20 and surface 12, or off of an odd number of the walls, such as view 45*d*, which will be vertically flipped, and will have an angle of inclination when projected through the window that is not at the actual angle of inclination of the view. Furthermore, there are other views at even numbers of reflections off of parallel walls that will present views at expected angles of elevations, but these tend to have smaller height profiles.

It will be noted that the heights of the views shown correspond to a highest profile for view 45*b*, a second highest profile for view 45*a*, and a far smaller profile for view 45*c*. The height profile of the views through PRID 10*d* present useful information for positioning and orientation of the PRID 10*d* with respect to the window 40, so that a good number of views are available to an occupant of the room that looks through the window 40, and more generally for the illumination pattern projected through the window 40.

It is worth noting that a substantial increase in illumination through window 40 is possible using a PRID, in part because of the very low light received through the window 40 from all angles of declination (declivity) from the window 40, in the absence of a planar reflective surface 12. The view 45*d* illustrates a view that may never be seen, but that contributes to lighting a basement room of the house. Without the planar reflective surface 12, substantially all illumination comes from angles of inclination that are steep enough to overcome the window well 44, which is, less than half the window's transmission capacity.

The additions of front and rear reflectors has a noticeable impact on the views, in PRID 10*d*, in comparison with, for example, the PRID 10*a*. While there will be substantially more light rejected by the PRID 10*d*, in comparison with that of PRID 10*a*, there is more light captured in the PRID of 10*d* than in PRID 10*a*. There may be more and better views in PRID 10*d*, or PRID 10*a*, depending on the setting, and there is advantage to providing a PRID that can optionally be configured to produce either PRID.

Regarding the FIG. 9, it will be noted that the illustrated views are simplifications of the actual lighting effects of the PRIDs. As noted above, there is no low cost surface that acts like a Boolean operator on light: that either reflects all, or transmits all light of all frequencies. The actual effect of a PRID will be complicated by the loss of some light during reflection, and the reflection of some light during transmission. View 45*a* may lose very little light through reflections at the entrances 16,18, as the light is substantially normal to the surfaces. View 45*c* may lose a more substantial amount of light at both entrances, and view 45*d* may lose substantial light through entrance 18, but not 16. This is not annotated in the drawing.

Figure 10:
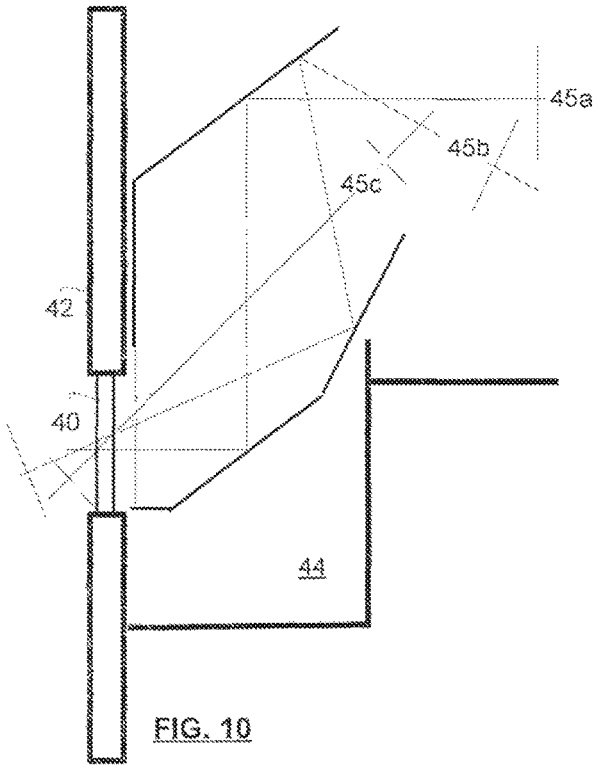
FIG. 10 is a schematic illustration of a side view of a periscopic device PRID having multiple planar reflective surfaces, showing how a plurality of views can be projected into a basement window by angular diversity.

FIG. 10 schematically illustrates profiles of diverse views through another variant PRID. Specifically it is a PRID 10*d* modified to include the flared, reflective, front wall 20' of PRID 10*c* and has a surface 25 that extends frontwards beyond that of PRID 10*d*, either of which modifications can be used alone. The flared reflective front wall acts as a second first surface, and therefore provides two doubly reflected views identified as 45*a,b*.

It will be noted that view 45*b* has an angle of declination, whereas previous views identified had only angles of inclination. If the ground surface nearby is diffusely reflective, declined views may be valuable to collect more reflected light, and if the ground slopes away from the building the view may be desirable.

View 45*c* may be a brightest mean daytime view for the window, or may be the only angle of inclination at which the sun shines directly on the window. The view 45*c* is unobstructed by the first and second surfaces but is only limited by a height of the window at that angle of elevation. Other angles of elevations are occluded by the second or first surfaces.

It will be appreciated that each of the PRIDs shown has a respective set of views that are projected through a window, and that spacing in front of the window, and orientation of the PRID will have an impact on the number and dimensions of the views, and generally the amount of light projected. In general, the views of sky at generally at higher angles of inclination, and higher angles of declination (for additional ground reflection), may be most valuable for collection of light, and presentation of views for security and aesthetics, may be provided by substantially horizontal views. The latter preferably have double reflections to invert, and reinvert the orientation of the view, so that the view is 'natural' both in how the specific view is seen, as well as how views vary with small changes in orientation of the viewer. The former need not be provided by double reflection (of near parallel surfaces), and can be projected at angles that are not aligned with a typical viewer in a typical position with respect to the window. The PRID embodiment of FIG. 10 is specifically designed to allow for these two desiderata by providing a periscopic device and providing a third entrance by separating the front wall from a top edge of the second surface, by way of the flaring of the front wall, to allow light from higher angles of inclination to fall on the front wall and first surface, with some of that light being reflected into the second entrance.

One other feature of the design of the PRID of FIG. 10 is the reflective floor separating the first surface from the second entrance. This small reflective surface may have considerable effect for reflecting more light through the window, and especially at increasing an angular diversity of light. It will be noted that the view 45*c* will not be reflected by the floor, as this angle is occluded by the flared front wall. This is expressly chosen to decrease a variability of illumination as a function of hour of day, so that the views of highest radiance are not increased, but many other views are projected out of the second entrance.

Having decided expressly not to build-in the PRID in accordance with the present invention, there is a need for stabilizing the PRID, preferably in a manner that does not require attachment to the building, wall, or the window, allowing the window to open outwards if that is its design. The PRID is said to be freestanding if it is not mechanically coupled to the wall.

It may be desirable for a PRID, with a light design, and a high surface area, to be grounded securely against winds. If the PRID is light enough, and the structural members are not stiff enough to do any damage, it may be an effective kite that poses little risk to humans and buildings, even if it loses its grounding. A low enough cost design may make such PRIDs practical and convenient.

Figure 11A:
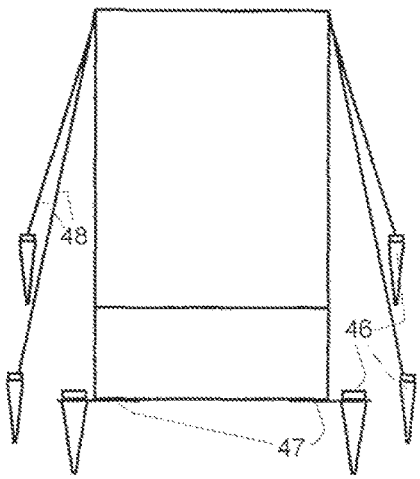
FIGS. 11A,B are schematic front and side elevational views of a PRID installed in a window well with grounding provided by spikes.

FIGS. 11*a,b* are front and side elevation views of PRIDs showing how it may be secured to the ground using 6 spikes 46, in a self-supporting manner. Two of the spikes are driven through a base plate 47 of the PRID into what is expected to be a pack of gravel, and four of the spikes stabilize top edges of the PRID, via tensioned lines 48, which may be of nylon or other suitable composition. By stabilizing the top edges front and back, and the bottom, the PRID may be stable enough to endure moderately high winds. While the four spikes are shown grounded in a same plane as the base plate spikes, it would be natural, and possibly preferable to ground these spikes at grade, as this allows an advantageous angle for tensioning the lines and resisting front to back forces on the broadest surfaces of the PRID, and uses less length of the tensioned lines.

The two base plate spikes may be preferably replaced with features like straps for gripping a massive object, such as a bag of sand, dirt or like fill, or a patio stone, cinder block, or a variety of such readily available materials.

Figure 12A:
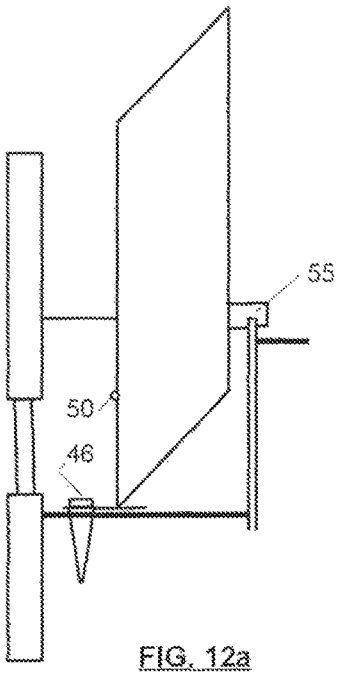
FIGS. 12A,B are side elevational and top plan views of a PRID installed in a window well with grounding provided by clamps and a horizontal compression bar.
Figure 12B:
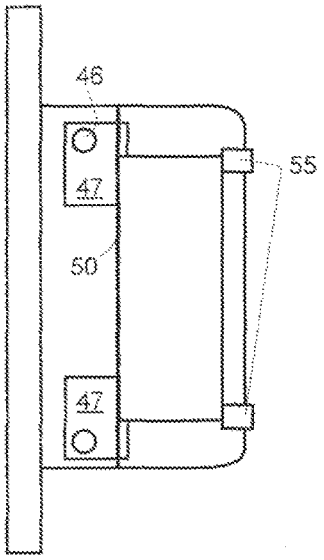

FIGS. 12*a,b* schematically illustrate side elevation and top plan views of a second set of attachment means for grounding a PRID. It will be any combination of these devices and those known in the art, or later developed in the art, that can equally be used may be advantageous. The embodiment of FIG. 12 avoids use of tensioned lines relying on greater internal stability of the top part of the PRID. A first grounding feature is a compression bar 50 that is coupled to the rear wall of the PRID and has a tip that is driven a small distance into two sidewalls of the window well, to support the PRID, preventing bulk translations and rotations in roll, and yaw. The compression bar 50 may be extended to drive into the side walls by screw threaded telescopic jointing, for example. Naturally the attachment means is chosen to suit the frame that supports the PRID. For example, the compression bar may be mounted to, or integral with horizontal member 36 of an embodiment such as that of FIG. 8. The horizontal bar may preferably be two bars that extend from each side, to allow greater flexibility in the sizes of window wells that can retain the PRID, while keeping a relatively small displacement of the compression bar.

Figure 11B:
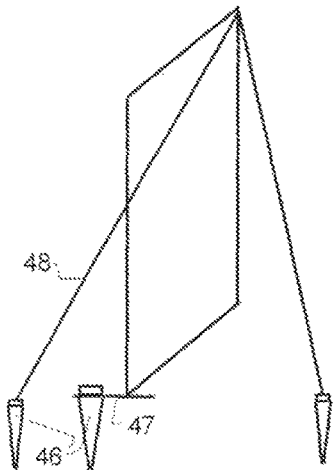

A second grounding device is shown as the two base plate spikes as shown in FIG. 11. This will prevent pitching of the PRID.

Finally a pair of clamps 55 is provided for further stabilizing the PRID. The clamps 55 are designed to grip a rim of the window well. In an embodiment such as that of FIG. 8, the clamps may be mounted to or integral with ends of sloping members 39. It is advantageous to mount to the rim of the window well because it is available and rigid, has a height and proximity to the PRID that are advantageous for mechanical coupling, and minimally obstructs the space around the PRID.

With the PRID thus grounded, a design of the structural members may be chosen to provide a required resilience to wind pressures and bending that the PRID will encounter, preferably with a small degree of warping of the projected views, and little affect to the spatial and angular distribution of illumination pattern provided by the PRID.

It may be preferable to design the PRID with low cost materials such as thin film (foil or web) reflective surfaces, supported with tent, or kite members, and a polymeric film, to provide a very low weight to the PRID, or to provide a kit for assembly in one of a variety of manners, to produce one of a variety of PRIDs. Such lightweight kits may have means to encircle or grip heavy, available, materials to ground the PRID, but remain portable, light, and easily packaged, stored, and transported.

Figure 13:
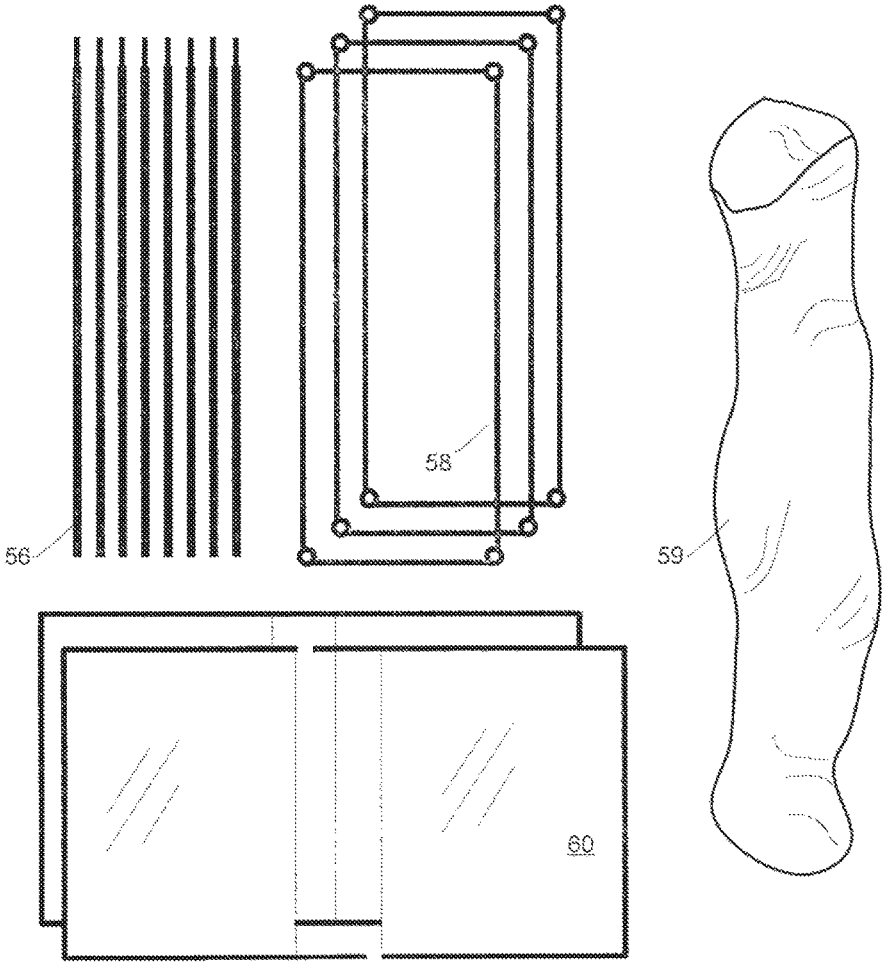
FIG. 13 is a schematic illustration of principal members of a kit for assembly a PRID, in accordance with an embodiment of the present invention.

FIG. 13 is a schematic illustration of principal members of such a kit. The kit includes 8 poles 56 having male and female ends for coupling to each other, 3 section members 58, 4 parts 60 bearing stiffened reflective surfaces for assembly to form first 12 and second 25 planar reflective surfaces, and a plastic sheath 59 for covering the assembly.

The section members 58 have, at each corner, eyes through which the poles 56 can pass. The three section members 58 are designed to be separated along a longitudinal extent of the PRID, to support the first surface 12, a middle of the PRID, and the top surface 25. The section members 58 may be identical, or may be different, to permit various configurations, and connections. The middle section member 58 may not engage any member other than the poles and the sheath 59. The middle section member 58 may be very thin or settable at a position closer to the top section member, to minimally block a natural view through the window and through the assembled PRID. The bottom section member 58 may couple to the first surface 12 as well as to a rim clamp (not shown, but may be like clamp 55) for clamping to a rim of the window well. The first surface 12, or the bottom section member 58 may be attached to a compression rod 50 previously shown.

The section members 58 may be expansible to increase a surface area defined by the section member 58, for example by providing paired u-shaped clamps, and a mechanism for separating them in one direction, or two I-shaped pieces that meet at corners. The expansion can equally be provided by moving the rods outwardly from the section members 58.

The parts 60 may be 4 identical parts, as shown, two pairs of identical parts, or 4 distinct parts, but they are intended for pairing to produce the planar reflective surfaces 12,25, that are preferably relatively stiff surfaces, with high reflectivities. In an alternative embodiment, the parts 60 that define the first surface 12 have a same length, and a larger width than those that define the second surface 25. The two parts 60 in the foreground are separated, and the two parts 60 in tile background are partially inserted into each other, showing one possible symmetric arrangement that allows a small parts count to be used to define smaller, and more easily transported members that define the kit. The parts 60 may be designed to be assembled in 2 or more configurations that have different surface areas, respectively, or to mount to the section members 58 at a variety or range of angles.

Thus assembly of the PRID may involve coupling pairs of the poles 56, inserting the coupled poles through the eyes of the section members 58, joining the parts 60 to form the first and second surfaces, coupling the first and second surfaces to the respective section members, placing this assembly into the sheath 59, and then expanding the section members 58 to tension the sheath 59, and plastically and elastically deform it. Top and bottom ends of the sheath 59 may be folded to close off the interior volume of the PRID to particulate material.

Tensioning ribbons may be applied, and tightened around the PRID, surrounding each of the section members 58, to apply a counteracting force against the expansion. These may further be used to assist in a gripping of the section members 58 and or surfaces 12,25 by clamping means and the like. Once the PRID is assembled, it can be placed and secured in a window well by first positioning a lower lip of the second surface 25 at a desirable offset and elevation with respect to the window, and securing the position with a compression rod that is mounted to the second surface, and expanding the compression rod to press into the sides of the window well a short distance, to provide a hinged mounting. Then the remaining degree of freedom may be secured by fixing a rim clamp to the rim of the window well. This mounting system requires only attachments to the window well, which may be desirable. A coupling to a ballasting weight may further be used to ensure that if a wind storm occurs, and one of the primary attachments is lost, the PRID does not blow away.

Applicant presently prefers to couple the rim clamp 55 and compression rod 50 to the PRID through the sheath 59, with care taken to prevent tearing of the sheath 59.

EXAMPLE

Applicant has produced a prototype and deployed it in a window well. The materials used for the prototype were: 48" 2 mil polytubing for the sheath; 1×3 softwood for the section members (only two were used, top and bottom); plastic coated metal rods; metal brackets for mounting; and ARMA FOIL-VB (TM) AFVB0333-17 taped directly to the sheath and stapled to the section member, for the planar reflective surfaces. Transparent packing tape was found to adhere very well to the polytubing. 4 pieces of galvanized strapping and two rods were used to lift the planar reflective surfaces from the bottom and top section members. This prototype stands to be improved in that the planar reflective surfaces did not remain flat, and the ARMA FOIL-VB as a material, is less specularly reflective than would be desired because of a quilting pattern, but in all other ways functioned well. The prototype withstood heavy snow, heavy wind, and freezing rain since the installation and is still standing. Lighting is noticeably improved in the basement window where the PRID is located over another basement window in the same wall receiving generally the same natural illumination. Applicant has found that two rim clamps slightly above the bottom section member are fully sufficient for anchoring this PRID.

The foregoing example and embodiments are intended to illustrate some of the features and aspects of the present invention as claimed, and not to be limiting. The features and aspects of the various embodiments are not limited to their combinations in the embodiments, unless and to the extent that it is noted or necessary for the functioning of the features, aspects, or achievement of their attendant advantages.

The invention claimed is:

1. A kit for assembly to make a planar reflective illumination device (PRID) the kit comprising:
   - a rectangular section of a reflective foil or web with a stiffener forming a first planar reflective surface;
   - first and second light entrances each having dimensions and orientations matching projections onto the first surface;
   - a set of members connectable to form a structure for supporting the first surface and the entrances in at least one fixed arrangement, in which first and second optical paths respectively between the first surface and the first and second entrances are not obstructed by any part of the PRID; and
   - a polymeric film for longitudinally surrounding at least the first optical path and the first surface, to enclose the optical paths sufficiently to reduce soiling of at least the first surface.

2. The kit of claim 1 where the second optical path is a linear path, and the first optical path includes a second planar reflective surface, the second surface being oriented with respect to the first entrance and first surface to reflect a view from the first entrance onto the first surface, such that the view is projected through the second entrance.

3. The kit of claim 2 wherein one, two or three of the following obtain: center normals of the first and second surfaces lie in a common, non-degenerate, plane; a line segment extending between the centers of the first and second surfaces is longer than a smallest planar dimension of the surfaces; and interior angles between the line segment and surfaces in the plane, on a same side of the line segment sum to 170°-190°.

4. The kit of claim 1 wherein the first and second optical paths respectively meet the first and second entrances substantially perpendicularly, in one or more of the at least one fixed arrangement and at least one of the entrances is provided by the polymeric film.

5. The kit of claim 1 wherein the stiffener comprises the polymeric film.

6. A kit for assembly to make a planar reflective illumination device (PRID) the kit comprising:

a first planar reflective surface;

first and second light entrances each having dimensions and orientations matching projections onto the first surface;

a set of members connectable to form a structure for supporting the first surface and the entrances in at least one fixed arrangement, in which first and second optical paths respectively between the first surface and the first and second entrances are not obstructed by any part of the PRID; and a polymeric film for longitudinally surrounding at least the first optical path and the first surface, to enclose the optical paths sufficiently to reduce soiling of at least the first surface, wherein the structure defines a frame that is collapsible by separating or moving Joints connecting the members, the joints being lockable in one or more of the fixed arrangements.

7. The kit of claim 6 where:

the second optical path is a linear path, and the first optical path includes a second planar reflective surface, the second surface being oriented with respect to the first entrance and first surface to reflect a view from the first entrance onto the first surface, such that the view is projected through the second entrance;

the assembled structure provides the second surface vertically aligned with the first entrance, and the first surface vertically aligned with the second entrance; and one, two or three of the following obtains: center normals of the first and second surfaces lie in a common, non-degenerate, plane; a line segment extending between the centers of the first and second surfaces is longer than a smallest planar dimension of the surfaces; and Interior angles between the line segment and surfaces in the plane, on a same side of the line segment sum to 170°-190°.

8. The kit of claim 6 where In the assembled form, the first and second optical paths respectively meet the first and second entrances substantially perpendicularly and at least one of the entrances is provided by the polymeric film.

9. The kit of claim 6 assembled to form the planar reflective illumination device.

10. A kit for assembly to form a planar reflective illumination device (PRID), the kit comprising:

a rectangular section of a reflective foil or web with a stiffener defining a first planar reflective surface;

a collection of members interconnectable to define a structure for supporting the first surface; and a polymeric film for surrounding at least a part of the structure;

where in assembled form:

the structure provides first and second optical paths extending from the first surface to first and second entrances respectively, without obstruction by any part of the PRID;

an angle of projection onto the first surface of a view from the first entrance via the first path is reflected onto the second path to exit the PRID at the second entrance; and the polymeric film surrounds at least the first path and the first surface sufficiently to reduce soiling of at least the first surface.

11. The kit of claim 10 further comprising a second planar reflective surface held by the structure with respect to the first surface in a fixed arrangement providing reflection of a view from the first entrance by the second surface, and subsequent reflection of the view by the first surface, for projection through the second entrance.

12. The kit of claim 11 wherein the assembled structure provides the second surface vertically aligned with the first entrance, and the first surface vertically aligned with the second entrance.

13. The kit of claim 10 wherein in the assembled form, the first and second optical paths respectively meet the first and second entrances substantially perpendicularly and at least one of the entrances is provided by the polymeric film.

14. A kit for assembly to make a planar reflective illumination device (PRID) the kit comprising:

a first planar reflective surface;

first and second light entrances each having dimensions and orientations matching projections onto the first surface;

a set of members connectable to form a structure for supporting the first surface and the entrances in at least one fixed arrangement, in which first and second optical paths respectively between the first surface and the first and second entrances are not obstructed by any part of the PRID; and a grounding mechanism for mechanically coupling to the structure for retaining the PRID in position within a window well, the grounding mechanism comprising at least one of; a tensionable line, a weight, a clamping mechanism for securing to a rim of a window well, and a compression rod.

15. The kit of claim 14 where the second optical path is a linear path, and the first optical path includes a second planar reflective surface, the second surface being oriented with respect to the first entrance and first surface to reflect a view from the first entrance onto the first surface, such that the view is projected through the second entrance.

16. The kit of claim 15 wherein one, two or three of the following obtains: center normals of the first and second surfaces lie in a common, non-degenerate, plane; a line segment extending between the centers of the first and second surfaces is longer than a smallest planar dimension of the surfaces; and interior angles between the line segment and surfaces in the plane, on a same side of the line segment sum to 170°-190°.

17. The kit of claim 14 wherein the first and second entrances extend substantially perpendicularly to the respective optical paths adjacent the respective entrance In at least one of the fixed arrangements and at least one of the entrances is provided by a polymeric film longitudinally surrounding at least the first optical path and the first surface.

18. The kit of claim 14, assembled to form the planar reflective illumination device.

* * * * *